United States Patent [19]

Baesgen et al.

[11] Patent Number: 4,909,049

[45] Date of Patent: Mar. 20, 1990

[54] BIELASTIC, WARP-KNIT FABRIC AND ITS PRODUCTION

[75] Inventors: Harald Baesgen; Helmut Schillings; Ernst Berg, all of Dormagen, Fed. Rep. of Germany

[73] Assignee: Bayer Aktiengesellschaft, Leverkusen, Fed. Rep. of Germany

[21] Appl. No.: 277,098

[22] Filed: Nov. 29, 1988

Related U.S. Application Data

[60] Division of Ser. No. 88,182, Aug. 21, 1987, which is a continuation of Ser. No. 900,552, Aug. 26, 1984, abandoned, which is a continuation of Ser. No. 587,083, Mar. 7, 1984, abandoned.

[30] Foreign Application Priority Data

Mar. 16, 1983 [DE] Fed. Rep. of Germany ..... 3309311

[51] Int. Cl.[4] ..... D04B 21/00; D04B 7/16

[52] U.S. Cl. ..... 66/195; 66/202

[58] Field of Search ..... 66/85 A, 195, 202

[56] References Cited

U.S. PATENT DOCUMENTS 3,572,058 3/1971 Richards et al. .

3,911,698 10/1975 Walford ..... 66/84 A

FOREIGN PATENT DOCUMENTS 48-20908 6/1973 Japan ..... 66/84 A

*Primary Examiner*—Ronald Feldbaum

*Attorney, Agent, or Firm*—Sprung Horn Kramer & Woods

[57] ABSTRACT

A bielastic warp-knit fabric with balanced behavior of the elastic forces in the longitudinal and transverse directions is obtained by guiding elasthane yarn as weft thread under the needle points in the tuck or laying position during the stitch-forming process, so that loops are formed during knocking-over.

1 Claim, 2 Drawing Sheets

BIELASTIC, WARP-KNIT FABRIC AND ITS PRODUCTION

Figure 1:
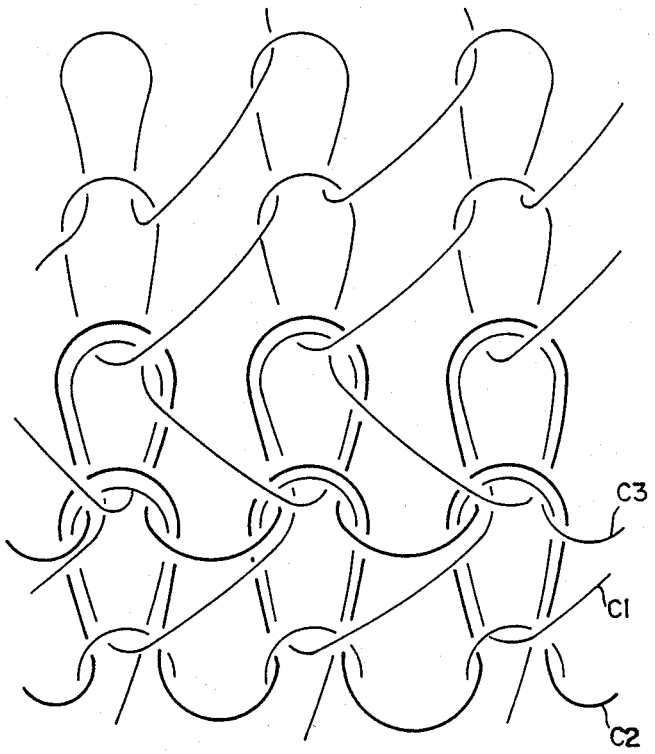

This is a division, of application Ser. No. 088,182, filed Aug. 21, 1987, now allowed; which is a continuation of Ser. No. 900,552, Filed Aug. 26, 1984, now abandoned; which is a continuation of Ser. No. 587,083, Filed Mar. 7, 1984, abandoned.

This invention relates to a bielastic, warp-knit fabric with balanced behaviour of the elastic forces in the longitudinal and transverse directions.

In contrast to weaving, where the fabrics are formed from thread systems crossing with one another at right-angles, warp knitting involves the interlacing of adjacent longitudinally extending warp threads to form stitches. This is done on warp knitting machines, raschel knitting machines and crochet gallooning machines. Some of the warp threads (approximately 5 to 50% by weight) may be elasthane yarns which impart elastic properties to the knitted fabric. Highly elastic garments, such as corsets and bathing costumes, may be produced from elastic knitted fabrics of this type (Bela von Falkai, Synthesefasern, Verlag Chemie, Weinheim, Deerfield Beach, Fla.; Basel, 1981, pages 189 to 190 and 348 to 351).

One of the disadvantages of elastic warp knit fabrics produced from warp threads of elasthane yarns lies in the fact that it is impossible to obtain balanced behaviour of the elastic forces of the knitted fabric in the transverse and longitudinal directions, irrespective of the ratio in which the elasthane yarns are used to the other yarns, referred to hereinafter as hard fiber yarns.

It has now surprisingly been found that a bielastic, warp-knit fabric with balanced behaviour of the elastic forces in the longitudinal and transverse directions can be produced if weft threads of elasthane yarn running transversely of the fabric web are transformed by means of the hooks and the knocking-over and holding-down sinkers into loops which are then incorporated into the ground warp knit fabric of the hard fiber yarn.

Accordingly, the present invention provides a bielastic warp-knit fabric characterized by loops of elasthane yarn bound horizontally into the stitches of the ground warp knit fabric. These loops are preferably interlaced.

The ground warp knit fabric preferably consists solely of hard fiber yarns. In this case, the bielastic warp-knit fabric according to the invention affords a further advantage in manufacturing terms insofar as, in contrast to conventional elastic warp-knit fabrics, there are no parallel, longitudinally extending elasthane yarns. This eliminates the need for the complicated and expensive warping of the elasthane yarns into elasthane yarn sectional beams, in addition to which the elasthane yarns can be offwound from standard bobbins for processing as weft yarn which is transformed into loops, preferably interlaced loops.

It is preferred to use elasthane yarns which have a stretchability of at least 250% and preferably from 450 to 650%, particularly those having deniers of from 10 to 960 dtex and preferably from 33 to 480 dtex.

It is possible to use bare elasthane filaments yarns and also wound or covered elasthane filament yarns. Bare elasthane filament yarns are preferred.

The knitted fabric according to the invention is produced by guiding the elasthane yarn, offwound from the bobbin as weft thread, beneath the needle points in the tuck or laying position during the stich-forming process, loops being formed during the knocking-over process. This can be done on any type of knitting machine, such as warp-knitting machines, raschel machines and crochet gallooning machines, either manually or, after appropriate modification, by machine.

The new technique is applicable to all warp-knitting patterns.

Although the introduction of weft threads into warp-knit fabrics using hard fiber yarns and elasthane yarns is already known, it has hitherto been carried out in a totally different manner and for another purpose. This is because the weft threads of hard fiber yarns do not take any part in the stitch-forming process and their purpose is to impart to the knitted fabric a stability corresponding to that of a woven fabric. For this reason, such weft threads are laid in between the hoop and the sinker loop.

Knitted fabrics of hard fiber yarns with weft threads of elasthane yarn smoothly laid in between hoops and sinker loops are not used because the weft threads smoothly laid in are not sufficiently bound into the knitted fabric. A knitted fabric of this type would only be elastic in one direction. Accordingly, weft threads of elasthane yarns smoothly laid in are only used in combination with warp threads of elasthane yarns which are precisely what the present invention seeks to avoid.

Figure 1A:
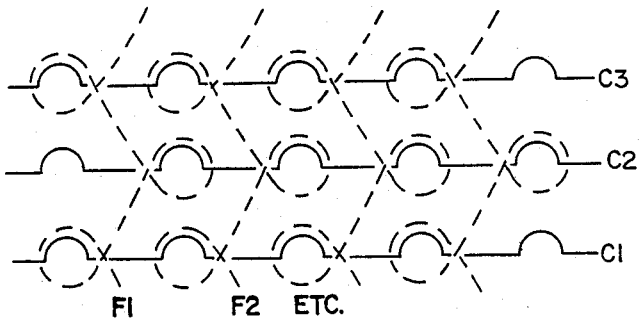

FIG. 1 shows a warp-knit fabric according to the invention with a simple pattern. $C_1$ denotes the longitudinally extending warp threads of hard fiber yarns. The thicker lines $C_2$ and $C_3$ represent two weft threads of elasthane yarn which are included in the stitch-forming process. FIG. 1*a* is the correspongind point diagram for FIG. 1. $C_1$, $C_2$ and $C_3$ represent the weft threads and $F_1$ and $F_2$ represent the longitudinally extending warp threads.

Figure 2:
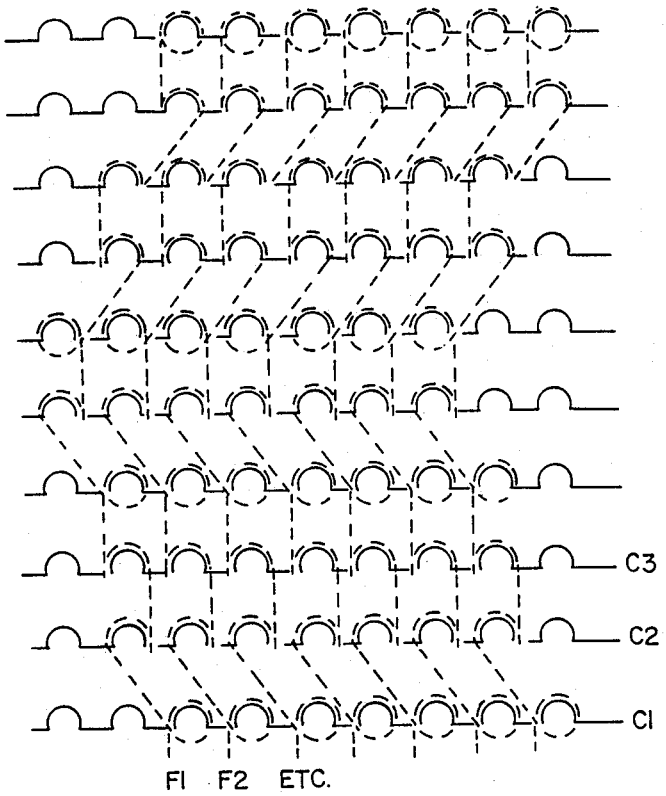

FIG. 2 is the corresponding point diagram for the fabric produced in the hereinbelow Examples. $C_1$, $C_2$ and $C_3$ represent the weft threads and $F_1$ and $F_2$ represent the warp threads.

EXAMPLE

A raschel machine (gauge 64E, working width 130") was operated in accordance with the following technical specification:

Material: guide bar I, polyamide filament yarn 44 dtex f10

Thread count: guide bar I 4140 threads

Pattern: guide bar I 4-6/2-4/4-2/2-4/0-2/2-0/4-2/2-4/4-2/6-4//

Material: weft threads of 160 dtex elasthane filament yarn transformed into loops.

In each row of stitches, one elasthane thread was horizontally incorporated into the stitch formation.

Rough stitch count/cm: 27.4

The knitted fabric obtained had 48 courses/cm and 25 wales/cm for a weight per unit area of 230 g/m$^2$.

The longitudinal elasticity amounts to 220% and the transverse elasticity to 250%.

The percentage by weight of elasthane amounts to 50%.

We claim:

1. A process for the production of a bielastic, warp-knit fabric in a warp knitting machine, said fabric comprising elasthane yarns and hard fiber yarns wherein loops of elasthane yarn are bound horizontally as weft thread into stitches of ground warp knit fabric of the hard fiber yarns and wherein the hard fiber yarns cover the elasthane yarns on both sides of the fabric said process comprising feeding said hard fiber yarn with a guide bar into the hooks of the needles of a warp knitting machine, feeding said elasthane weft yarn horizontally across and into the hooks of all said needles, knitting together said hard fiber yarns and elasthane yarns simultaneously into stitches forming a bielastic warp knit fabric, whereby the elasthane yarns are bound horizontally as weft knit stitches into the warp knit ground fabric.

* * * * *